US007002426B2

(12) United States Patent
Kingston et al.

(10) Patent No.: US 7,002,426 B2
(45) **Date of Patent: *Feb. 21, 2006**

(54) ABOVE RESONANCE ISOLATOR/CIRCULATOR AND METHOD OF MANUFACTURE THEREOF

(75) Inventors: James Kingston, Pepperell, MA (US); George Hempel, Hanson, MA (US)

(73) Assignee: M/A-COM, Inc., Lowell, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/383,718

(22) Filed: Mar. 6, 2003

(65) Prior Publication Data

US 2004/0174225 A1 Sep. 9, 2004

(51) Int. Cl.
*H01P 1/36* (2006.01)
*H01P 1/38* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

| | | | | |
|---|---|---|---|---|
| 3,614,675 A | | 10/1971 | Konishi | 333/24.2 |
| 3,621,476 A | | 11/1971 | Kanbayashi | 333/1.1 |
| 4,761,621 A | | 8/1988 | Kane et al. | 333/1.1 |
| 4,806,886 A | | 2/1989 | Stern et al. | 333/24.2 |
| 5,615,473 A | * | 4/1997 | Dydyk et al. | 29/602.1 |
| 5,898,346 A | | 4/1999 | Kamei et al. | 333/1.1 |
| 6,087,905 A | * | 7/2000 | Makino et al. | 333/1.1 |
| 6,130,587 A | | 10/2000 | Jun et al. | 333/24.2 |
| 6,507,249 B1 | | 1/2003 | Schloemann | 333/1.1 |
| 6,566,972 B1 | | 5/2003 | Paquette et al. | 333/1.1 |
| 6,633,205 B1 | | 10/2003 | Jussaume et al. | 333/1.1 |
| 6,690,248 B1 | | 2/2004 | Kawanami et al. | 333/24.2 |

* cited by examiner

*Primary Examiner*—Timothy P. Callahan
*Assistant Examiner*—Terry L. Englund

(57) ABSTRACT

An above resonance circulator/isolator and method for manufacturing the same is described. In one implementation, the above resonance circulator/isolator includes a magnet, a spacer, a single ferrite element, a center conductor and a pole piece. The center conductor is sandwiched between the magnet and the single ferrite element with the spacer interposed between the magnet and the center conductor. The pole piece is coupled to the single ferrite element, such that the single ferrite element is sandwiched between the center conductor and the pole piece. Magnetic shielding is not necessary in particular implementations.

12 Claims, 4 Drawing Sheets

ABOVE RESONANCE ISOLATOR/CIRCULATOR AND METHOD OF MANUFACTURE THEREOF

CROSS-REFERENCE TO RELATED APPLICATIONS

This application is related to U.S. patent application entitled "Above Resonance Isolator/Circulator and Method of Manufacture Thereof" identified by Ser. No. 10/383,717 filed on the same day herewith, which is hereby incorporated by reference.

TECHNICAL FIELD

The present invention relates generally to above resonance isolators/circulators.

BACKGROUND

Above resonance circulators and isolators are devices used in radio and radar frequency applications. Current industry standards for above resonance circulators/isolators typically require the use of multiple ferrite pieces and a plurality of other components used to separate the ferrites. Additionally, most above resonance circulators/isolators use magnetic shielding such as a metal housing to encase magnets and ferrites. Reducing costs associated with manufacturing such devices is paramount in today's competitive market place. To date, attempts to substantially reduce such costs have been largely unsuccessful.

SUMMARY

An above resonance circulator/isolator and method for manufacturing the same is described. In one implementation, the above resonance circulator/isolator includes a magnet, a spacer, a single ferrite element, a center conductor, and a pole piece. The center conductor is sandwiched between the magnet and the single ferrite element with the spacer interposed between the magnet and the center conductor. The pole piece is coupled to the single ferrite element, such that the single ferrite element is sandwiched between the center conductor and the pole piece.

The following exemplary implementation introduces the broad concept of manufacturing an above resonance circulator/isolator without magnetic shielding, such as in the form of a housing unit. Accordingly, magnetic shielding is not necessary to bias ferrite material in the above resonance circulator/isolator. The following exemplary implementation also introduces the broad concept of manufacturing an above resonance circulator/isolator using only a single ferrite element.

Thus, by virtue of using only a single ferrite element instead of multiple ferrite elements, and eliminating magnetic shielding, it is possible to greatly reduce a substantial number of components traditionally used in above resonance circulator/isolators. Costs associated with manufacturing an above resonance circulator/isolator are, therefore, substantially reduced.

BRIEF DESCRIPTION OF THE DRAWINGS

The detailed description is described with reference to the accompanying figures. In the figures, the left-most digit(s) of a reference number identifies the figure in which the reference number first appears.

DETAILED DESCRIPTION

Exemplary Architecture With Magnetic Shielding

Figure 1:
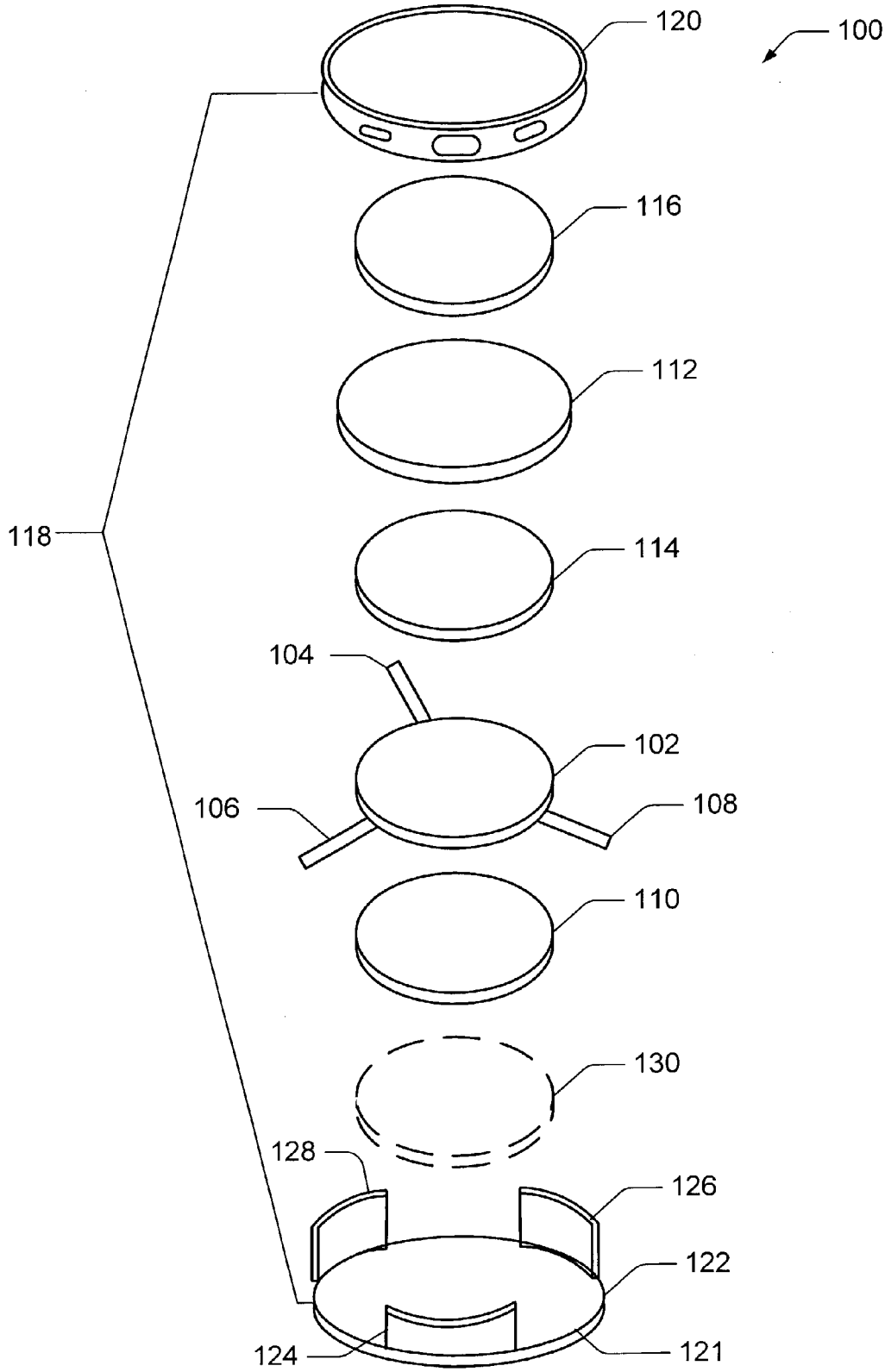
FIG. 1 is an exploded view of various components of an exemplary above resonance circulator/isolator that can be utilized to implement the inventive techniques described herein.

FIG. 1 is an exploded view of various components of an exemplary above resonance circulator/isolator 100 that can be utilized to implement the inventive techniques described herein. Above resonance circulator/isolator 100 includes a center conductor 102 that includes some type of resonating circuitry embedded thereon. Center conductor 102 includes three ports or connectors 104, 106, and 108. Some center conductors, however, may use more or less than three ports and for purposes of this discussion any of these variety of center conductors may represent center conductor 102. Center conductor 102 is in the shape of a disc, but may utilize other shapes such as, but not limited to, an oval, square, or ellipse.

Positioned directly below the center conductor 102 is a single ferrite element 110 that is substantially or completely magnetized. Center conductor 102 can be slightly separated from single ferrite element 110 through the use of some type of separation part (including an epoxy or glue, not shown). In the exemplary illustration, however, there are no components or gaps interposed between single ferrite element 110 and center conductor 102. Center conductor 102 and single ferrite element 110 are held together through compression exerted by forces applied by housing unit 118 to be described in more detail below.

In the exemplary illustration, single ferrite element 110 is in the shape of a disc, but may be implemented using other shape configurations. As shown in FIG. 1, only a single ferrite element 110 is used in above resonance circulator/isolator 100, eliminating the use of multiple ferrites in a traditional above resonance circulator/isolator. Although, only a single ferrite element 110 is shown, this does not preclude the use of a ferrite element that includes a conglomeration of two or more ferrite pieces forming a single ferrite element. For instance, it is envisioned that multiple ferrite discs can be stacked together to form a single ferrite element.

Positioned above the center conductor 102 is a magnet 112. Magnet 112 is generally larger than the single ferrite element 110 and may be implemented in various shapes such as ovals, ellipses, etc. Separating magnet 112 from center conductor 102 is a spacer 114. Spacer 114 may be implemented using one or more materials from epoxy to harder materials such as a dielectric. Spacer 114 is generally between about 1 mil to 20 mils thick, although it may be possible to use slightly thinner of thicker spacers depending on the application.

Positioned above magnet 112 is a cover return 116. Cover return 116 is generally in the shape of a disc, but may be implemented in a variety of shapes, such as ovals, ellipses, etc. Cover return 116 is generally made of some type of steel material or related material capable of shielding magnet fields.

Housing unit 118 encases and springably compresses: cover return 116, magnet 112, spacer 114, single ferrite element 110 and center conductor 102. In the exemplary implementation, housing unit 118 includes a top piece 120 and bottom piece 122. Top piece 120 is in the form of a top retainer and can be made of a metal material, or other materials such as plastic or ceramic.

Bottom piece 122 is in the form of a cup shaped piece with three male prongs 124, 126, and 128, perpendicular to the base 121 of bottom piece 122. Gaps between the prongs 124, 126, 128 provide spaces for connectors 104, 106, and 108 to extend beyond housing unit 118. Bottom piece 122 is preferably made of some type of metal material, such as steel, to provide shielding of magnetic fields, but can be implemented with non-metallic materials. In the event bottom piece 122 is not implemented with metal, then an optional pole piece 130 is needed to provide a ground plane for above resonance circulator/isolator 100. Otherwise, if the bottom piece is implemented with some type of metallic material, it is possible for bottom piece 122 to act as the ground plane and eliminate the need for optional pole piece 130.

Top piece 120 is configured to snap down over each of the male prongs 124, 126 and 128. For instance, male prongs 124, 126, and 128 may lock into an internal ridge located in top piece 120. The total height of the housing unit 118 is designed to be approximately even with or slightly lower than the uncompressed cumulative height of cover return 116, magnet 112, spacer 114, the single ferrite element 110 and center conductor 102 when each is stacked upon each other. Accordingly, when bottom piece 122 and top piece 120 engage each other, they both assert a compression force on all components they encase (e.g., cover return 116, magnet 112, spacer 114, the single ferrite element 110 and center conductor 102). It is also possible to use an elastic packing material to fill any potential voids at the bottom or top of the housing unit 118, in the event the total height of the housing unit 118 is greater than the uncompressed cumulative height of cover return 116, magnet 112, spacer 114, the single ferrite element 110 and center conductor 102, when each is stacked upon the other.

It is envisioned that the housing unit 118 can be implemented using alternative configurations that do not necessarily have to compress the components of the above resonance resonator 100. For example, it is possible that the housing unit 118 could be implemented as two halves configured to attach to each other. The housing unit 118 could be in the form of a preformed cylinder or box that is capable of encasing components of the above resonance resonator 100. Fastening materials could also be used to attach the components of the housing unit 118 together. Additionally, components within the housing unit (such as magnet 112, center conductor 102, etc.) also may be coupled to each other by fastening materials such as epoxy in the event that compression forces are not applied by the housing unit 118.

It is to be appreciated that while FIG. 1 shows the components of above resonance circulator/isolator 100 in a certain order from top to bottom, their order could be reversed, for instance, by placing the cover return 116 on the bottom and single ferrite element 110 on the top, with all the other elements in between reversed. Alternatively, it is also possible to reverse the top piece 120 and bottom piece 122 of housing unit 118.

Referring back to the exemplary order of components shown in FIG. 1, magnetic fields from the magnet 112 are coupled downward toward and into single ferrite element 110 (assuming the top of magnet 112 is north and the bottom south). The bottom piece 122 serves as a ground for the magnetic fields. A magnetic circuit is created from magnet 112 to the bottom piece 122 and back up to cover return 116. All components below magnet 112 behave as an air gap with respect to magnet 112, because no metal elements are interposed between magnet 112, spacer 114, single ferrite element 110, and center conductor 102. Accordingly, magnetic fields travel down to the bottom piece 122 from magnet 112 and back up the sides (such as 124, 126, and 128) of housing 118 through the cover return 116 and back to the other polarity of magnet 112.

Figure 2:
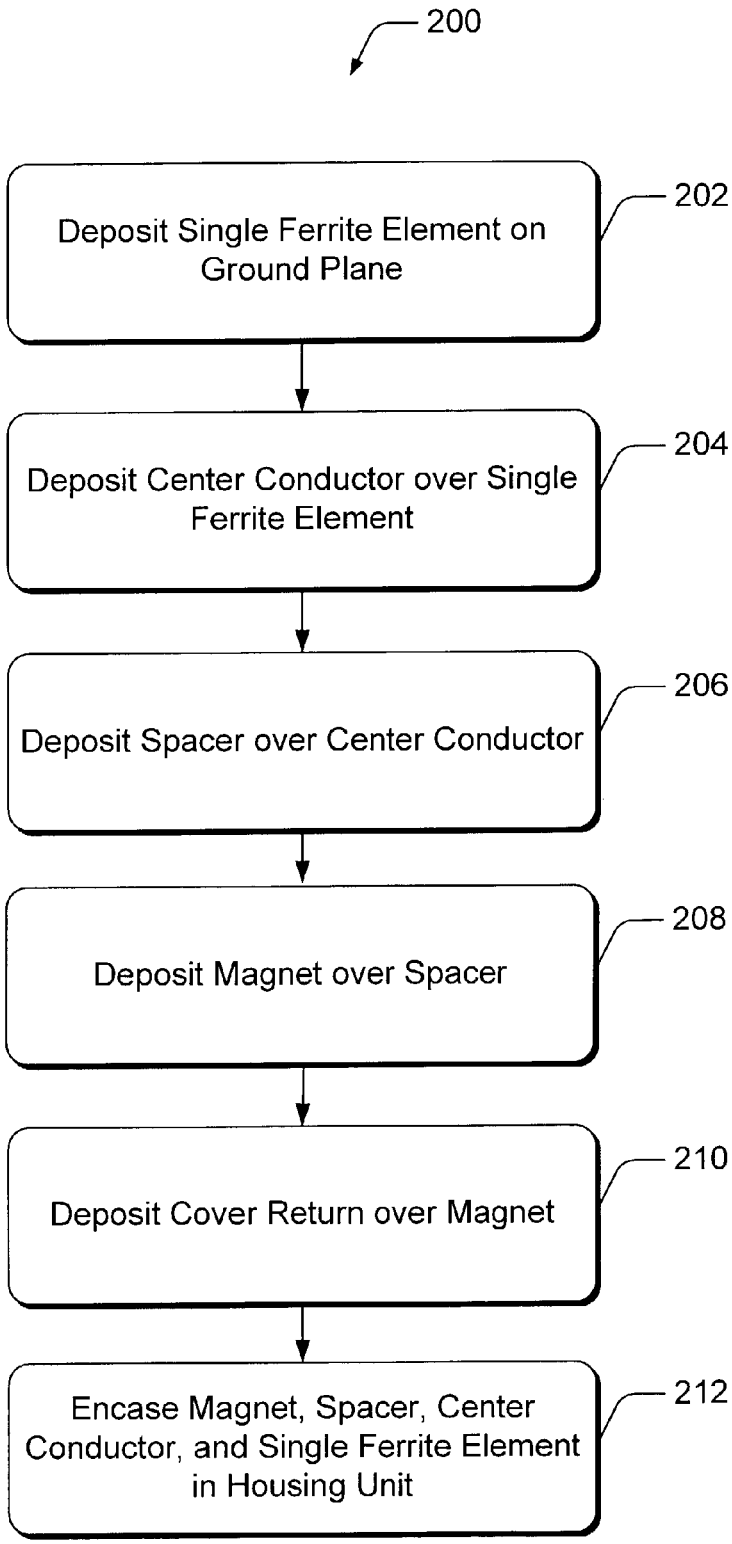
FIG. 2 is a method for making an above resonance isolator/circulator.

FIG. 2 is a method 200 for making an above resonance isolator/circulator, such as the exemplary one shown in FIG. 1. Method 200 includes blocks 202–212. The order in which the method is described is not intended to be construed as a limitation.

In block 202, a single ferrite element is deposited on top of the bottom piece (or cup) of a housing. For example, single ferrite element 110 (FIG. 1) is placed on top of bottom piece 122, which acts as a ground plane.

In block 204, a center conductor is deposited on top of the single ferrite element 110. For example, center conductor 102 is deposited directly on top of single ferrite 110.

In block 206, a spacer is deposited on top of the center conductor. For example, spacer 114 is deposited on top of center conductor 102.

In block 208, a magnet is deposited on top of the spacer. For example, magnet 112 is deposited on top of spacer 114. Thus, at this point, the single ferrite element 110 is underneath the center conductor 102 such that the single ferrite element 110 is opposite the magnet 112 and the center conductor 102 is sandwiched between the spacer 114 and the single ferrite element 110. No metal element is interposed between any of the magnet 112, the spacer 114, the single ferrite element 110, and the center conductor 102.

In block 210, a cover return is deposited on top of the magnet. For example, cover return 116 is deposited on top of magnet 112.

In block 212, the cover return, spacer, magnet, center conductor, and single ferrite element are encased in some type of housing unit. For example, cover return 116, spacer 114, magnet 112, center conductor 102, and single ferrite element 110 are encased in housing unit 118.

Exemplary Architecture Without Magnetic Shielding

Figure 3:
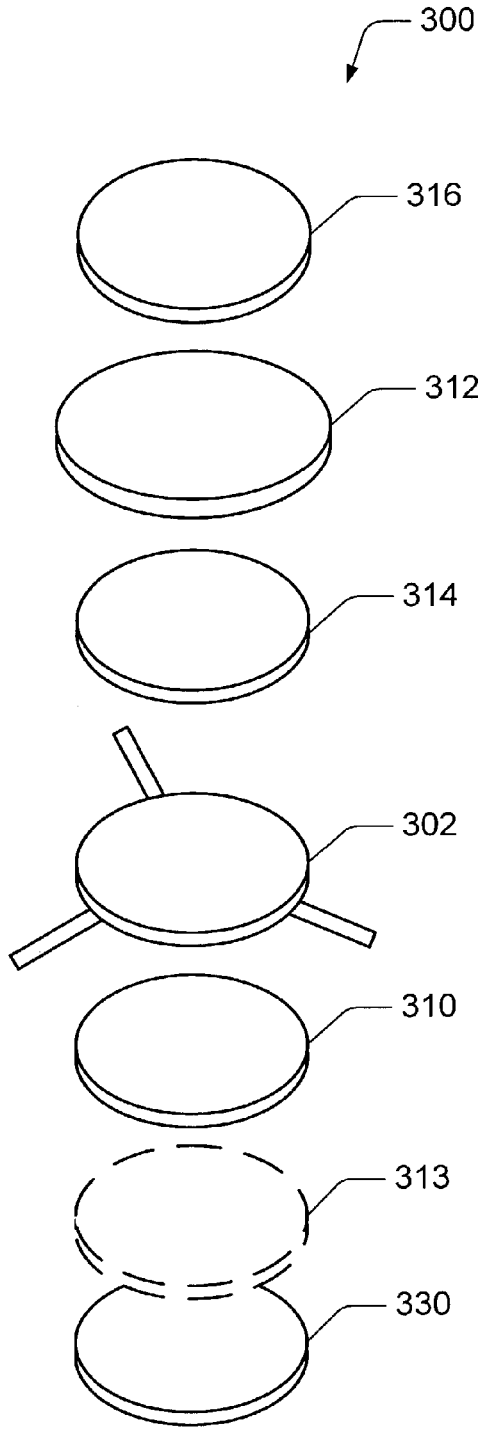
FIG. 3 is another exploded view of various components of an exemplary above resonance circulator/isolator that can be utilized to implement the inventive techniques described herein.

FIG. 3 is an exploded view of various components used in an exemplary above resonance circulator/isolator 300. Above resonance circulator/isolator includes a magnet 312, a spacer 314, a center conductor 302, a single ferrite element 310, and a pole piece 330. Unlike above resonance circulator/isolator 100, shown in FIG. 1, the above resonance circulator/isolator 300 uses an open architecture that does not require the use of magnetic shielding to bias ferrite material. That is, no proximate magnetic shielding, such as a housing unit, is used to encase magnet 312, spacer 314, single ferrite element 310, center conductor 302, or pole piece 330. Thus, it is possible to greatly reduce the quantity of components used in an above resonance circulator/isolator; and hence, greatly reduce costs.

Magnet 312, center conductor 302, pole piece 330, and single ferrite element 310 are similar to like elements with similar reference numbers described above with reference to FIG. 1. On the other hand, spacer 314 used between magnet 312 and center conductor 302 is preferably an epoxy material, such as non-conductive liquid epoxy. Other nonconductive materials with the ability to fasten two components, such as glue, also may be used. Spacer 314 is generally between about 1 mil to 20 mils thick, although it may be possible to use slightly thinner of thicker spacers depending on the application.

Single ferrite element 310 is mounted underneath the center conductor 302. A non-conductive liquid epoxy is used to attach single ferrite element 310 to center conductor 302. Alternatively, single ferrite element 310 may be fastened to center conductor 302 by clips or other mechanical devices.

Pole piece 330 is coupled to the single ferrite element 310 by epoxy 313. In one implementation, epoxy 313 is a liquid epoxy that may include conductive materials such as silver, gold, or other conductive materials. Pole piece 330 serves as the ground plane for above resonance circulator/isolator 300.

In operation, above resonance circulator/isolator 300 functions without magnetic shielding. Magnet 312 is larger than single ferrite element 310. In the exemplary illustration, magnet 312 has a larger diameter than single ferrite element 310, which causes magnetic fields to travel from the south side of magnet 312 (i.e., from the bottom of magnet 312) to pole piece 330 and return north (i.e., upwards from pole piece 330) by traveling through air.

It is to be appreciated that while FIG. 3 shows the components of above resonance circulator/isolator 300 in a certain order from top to bottom, their order could be reversed, for instance, by placing the pole piece 330 on the top and magnet 312 on the bottom, with all the other elements in between reversed.

Figure 4:
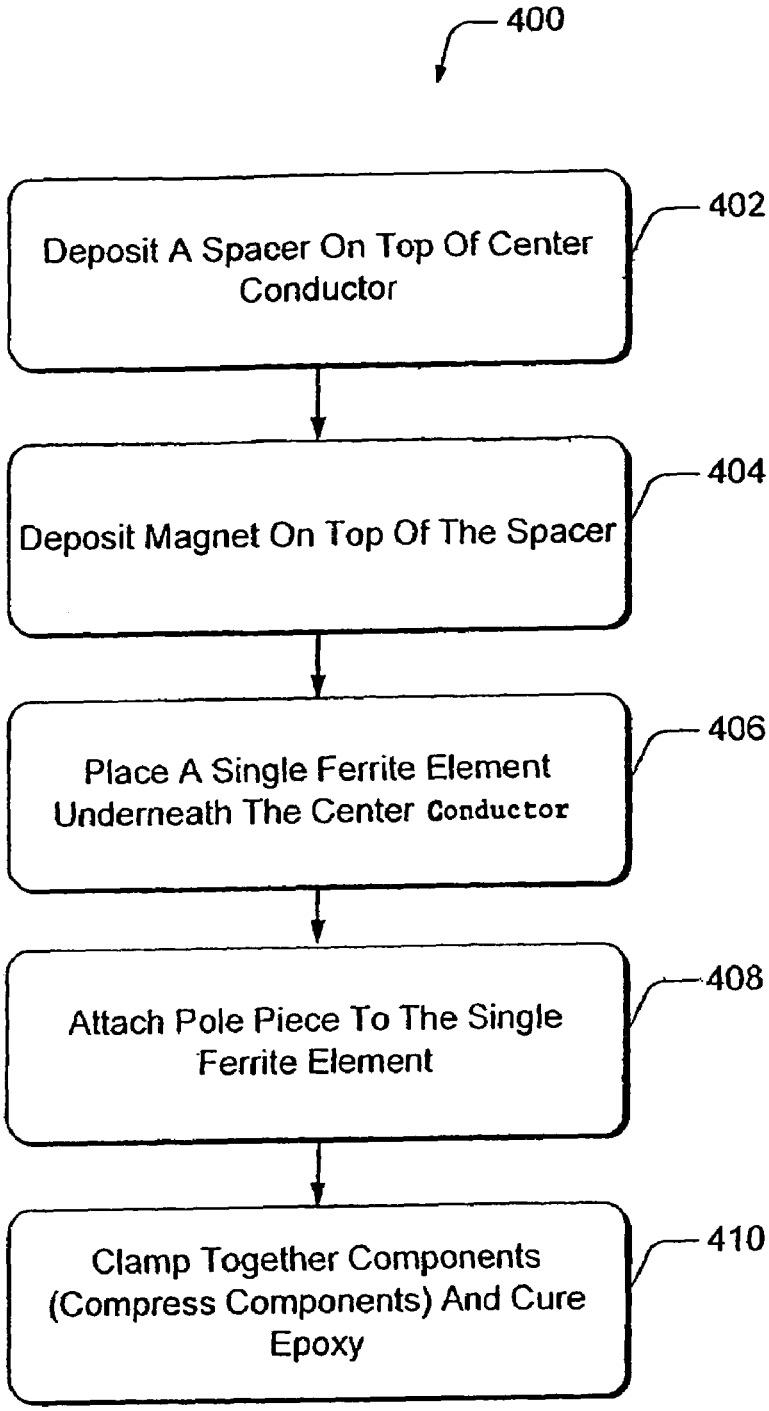
FIG. 4 is a method for making an above resonance isolator/circulator, such as the exemplary one shown in FIG. 3.

FIG. 4 is a method 400 for making an above resonance isolator/circulator such as the exemplary one shown in FIG. 3. Method 400 includes blocks 402–410. The order in which the method is described is not intended to be construed as a limitation.

In block 402, a spacer is deposited on top of a center conductor. For example, liquid epoxy 314 is deposited on center conductor 302.

In block 404, a magnet is deposited on top of the spacer. For example, magnet 312 is deposited on to spacer 314.

In block 406, a single ferrite element is placed underneath the center conductor such that the single ferrite element is opposite the magnet and the center conductor is sandwiched between the spacer and the single ferrite element. For example, single ferrite element 310 is attached to the bottom of center conductor 302 via a liquid epoxy. At this point, no metal element is interposed between any of the magnet 312, spacer 314, single ferrite element 310, and the center conductor 302.

In block 408, a pole piece is attached to the single ferrite element, so that the single ferrite element is sandwiched between the center conductor and the pole piece. The pole piece is coupled to the single ferrite element by an epoxy. For example, pole piece 330 is attached to single ferrite element 310 by interposing a liquid epoxy 313 between the pole piece 330 and single ferrite element 310.

In block 410, all the aforementioned components described in blocks 402–408 are clamped together and cured in an oven under compression. For example, vertical compression may be applied to the components with a mechanical actuator and cured for 30 minutes at 150 degrees Celsius. Other cure temperatures and cure times are possible.

Although some implementations of the various methods and arrangements of the present invention have been illustrated in the accompanying Drawings and described in the foregoing Detailed Description, it will be understood that the invention is not limited to the exemplary aspects disclosed, but is capable of numerous rearrangements, modifications and substitutions without departing from the spirit of the invention as set forth and defined by the following claims.

What is claimed is:

1. An above resonance isolator/circulator, comprising:
a magnet;
a spacer;
a single ferrite element;
a center conductor sandwiched between the magnet and the single ferrite element with the spacer interposed between the magnet and the center conductor; and
a pole piece coupled to the single ferrite element, such that the single ferrite element is sandwiched between the center conductor and the pole piece;
wherein no immediate magnetic shielding is used to encase the magnet, the spacer, the single ferrite element, the center conductor, and the pole piece.

2. The above resonance isolator/circulator as recited in claim 1, wherein the spacer is a non-conductive epoxy.

3. The above resonance isolator/circulator as recited in claim 1, wherein the pole piece is coupled to the single ferrite element by epoxy.

4. The above resonance isolator/circulator as recited in claim 1, wherein the pole piece is coupled to the single ferrite element by epoxy that includes dielectric beads.

5. The above resonance isolator/circulator as recited in claim 1, wherein the magnet is larger than the single ferrite element.

6. The above resonance isolator/circulator as recited in claim 1, wherein the spacer is between about 1 mil and 20 mils thick.

7. An above resonance isolator/circulator, comprising:
a magnet;
a spacer positioned directly underneath the magnet;
a center conductor positioned directly underneath the spacer;
a single ferrite element positioned directly underneath the spacer; and
a ground plane positioned underneath the single ferrite element, wherein no metal elements are interposed between adjacent ones of the magnet, the spacer, the single ferrite element, and the center conductors;
wherein no immediate magnetic shielding is used to encase the magnet, the spacer, the single ferrite element, the center conductor, and the ground plane.

8. The above resonance isolator/circulator as recited in claim 7, wherein the magnet is larger than the single ferrite element.

9. The above resonance isolator/circulator as recited in claim 7, wherein the spacer is between about 1 mil and 20 mils thick.

10. The above resonance isolator/circulator as recited in claim 7, wherein the spacer is a non-conductive epoxy.

11. The above resonance isolator/circulator as recited in claim 7, wherein the ground plane is coupled to the single ferrite element by epoxy.

12. The above resonance isolator/circulator as recited in claim 7, wherein the ground plane is coupled to the single ferrite element by epoxy that includes conductive material.

* * * * *